US007083818B2

(12) United States Patent
Pratte

(10) Patent No.: US 7,083,818 B2
(45) Date of Patent: Aug. 1, 2006

(54) PARTY TRAY

(75) Inventor: Wesley Paul Pratte, Arroyo Grande, CA (US)

(73) Assignee: Apio, Inc., Guadalupe, CA (US)

( * ) Notice: Subject to any disclaimer, the term of this patent is extended or adjusted under 35 U.S.C. 154(b) by 39 days.

(21) Appl. No.: 10/222,435

(22) Filed: Aug. 16, 2002

(65) Prior Publication Data

US 2004/0033338 A1 Feb. 19, 2004

(51) Int. Cl.
*B65B 25/04* (2006.01)
*B65D 25/04* (2006.01)

(52) U.S. Cl. ..... 426/394; 426/392; 426/396; 426/419; 426/115; 426/120

(58) Field of Classification Search ..... 426/106, 426/112, 115, 119, 120, 389, 392, 394, 395, 426/113, 114, 396, 418, 419; 206/541, 545, 206/548, 216, 562, 563, 561, 564, 557, 546; 220/23.83, 529, 532, 555
See application file for complete search history.

(56) References Cited

U.S. PATENT DOCUMENTS

| | | | | |
|---|---|---|---|---|
| 2,731,996 | A | 1/1956 | Hayes | 150/5 |
| 3,031,309 | A * | 4/1962 | Bogner et al. | 426/90 |
| 3,038,625 | A * | 6/1962 | Sinner et al. | 217/33 |
| 3,079,028 | A | 2/1963 | Rosner | 220/22 |
| 3,104,776 | A | 9/1963 | Bostrom | |
| 3,107,027 | A | 10/1963 | Hong | 220/23.8 |
| 3,244,537 | A | 4/1966 | Cease | 99/192 |
| 3,247,988 | A | 4/1966 | Cease | 214/301 |
| 3,301,460 | A | 1/1967 | Harrison | 229/15 |
| 3,305,126 | A | 2/1967 | Cease | 220/23.83 |
| 3,487,972 | A | 1/1970 | Swett | 220/20 |
| 3,507,667 | A | 4/1970 | Magnen | 99/171 |
| 3,610,458 | A * | 10/1971 | Nissley | 220/23.4 |
| 3,749,299 | A * | 7/1973 | Ingle | 229/120.34 |
| 4,081,646 | A | 3/1978 | Goltsos | 219/10.55 |
| D250,928 | S | 1/1979 | Franklin | D7/27 |
| 4,272,008 | A * | 6/1981 | Wozniacki | 229/120.23 |
| 4,328,254 | A * | 5/1982 | Waldburger | 426/393 |
| 4,335,842 | A | 6/1982 | Bradford et al. | 229/25 |
| D269,930 | S | 8/1983 | Powers | D7/1 |
| 4,574,174 | A | 3/1986 | McGonigle | 219/10.55 |
| 4,593,816 | A * | 6/1986 | Langenbeck | 206/425 |

(Continued)

FOREIGN PATENT DOCUMENTS

| | | |
|---|---|---|
| EP | 035116 | 1/1990 |

(Continued)

OTHER PUBLICATIONS

Merriam-Webster Online. http//www.m-w.com.*

(Continued)

*Primary Examiner*—Milton I. Cano
*Assistant Examiner*—Robert Madsen
(74) *Attorney, Agent, or Firm*—Jeffrey G. Sheldon; Sheldon & Mak PC

(57) ABSTRACT

A party tray includes a support tray and, on the support tray, a sealed package made up of transparent container body and a polymeric sealing sheet sealed to the rim of the container body. The sealed package contains foodstuffs, in particular respiring foodstuffs such as fresh fruits and vegetables, which rest on the sealing sheet; the sealing sheet is in turn supported by the support tray. The sealed package may include an atmosphere control member. When the party tray is on display, its contents are viewed through the single thickness of the container body.

23 Claims, 5 Drawing Sheets

U.S. PATENT DOCUMENTS

| | | | | |
|---|---|---|---|---|
| 4,660,716 | A | 4/1987 | McMahon et al. | 206/216 |
| 4,769,262 | A | 9/1988 | Ferrar et al. | 428/35 |
| 4,842,875 | A | 6/1989 | Anderson | 426/118 |
| 4,874,083 | A * | 10/1989 | Antoni et al. | 220/523 |
| 4,879,078 | A | 11/1989 | Antoon | 264/41 |
| D305,205 | S | 12/1989 | Grindrod et al. | D9/418 |
| D305,409 | S | 1/1990 | Michaud et al. | D9/425 |
| 4,910,032 | A | 3/1990 | Antoon | 426/118 |
| 4,923,703 | A | 5/1990 | Antoon | 426/118 |
| 4,939,332 | A | 7/1990 | Hahn | 219/10.55 |
| 4,966,295 | A | 10/1990 | Parrish | 220/22.3 |
| D318,207 | S | 7/1991 | Anderson | D7/549 |
| 5,045,331 | A * | 9/1991 | Antoon, Jr. | 426/118 |
| 5,160,768 | A | 11/1992 | Antoon | 428/35.2 |
| 5,254,354 | A | 10/1993 | Stewart | 426/106 |
| 5,277,329 | A | 1/1994 | Pomroy et al. | 220/526 |
| D361,508 | S | 8/1995 | Schnack | D9/425 |
| D382,796 | S | 8/1997 | Mangla | D9/420 |
| 5,657,874 | A | 8/1997 | Hustad et al. | 206/724 |
| 5,672,406 | A | 9/1997 | Challis et al. | 428/136 |
| D384,861 | S | 10/1997 | Richard | D7/553 |
| 5,832,699 | A | 11/1998 | Zobel | 53/461 |
| 5,908,649 | A | 6/1999 | Floyd et al. | 426/109 |
| D415,422 | S | 10/1999 | McCann | D9/429 |
| 6,013,293 | A | 1/2000 | De Moor | 426/106 |
| 6,092,664 | A | 7/2000 | Bartosek | 206/784 |
| RE36,867 | E | 9/2000 | Rozzano | 426/87 |
| 6,210,724 | B1 | 4/2001 | Clarke et al. | 426/118 |
| 6,296,923 | B1 | 10/2001 | Zobel | 428/137 |
| 6,376,032 | B1 | 4/2002 | Clarke et al. | 428/34.7 |
| 6,447,825 | B1 * | 9/2002 | Korsten | 426/115 |
| 6,595,366 | B1 * | 7/2003 | Brown | 206/551 |
| 2003/0031769 | A1 | 2/2003 | Wyslotsky | 426/397 |
| 2003/0057217 | A1 * | 3/2003 | Wyslotsky et al. | 220/912 |
| 2003/0087015 | A1 | 5/2003 | Wyslotsky | 426/397 |

FOREIGN PATENT DOCUMENTS

| | | | |
|---|---|---|---|
| EP | 437082 | A1 * | 7/1991 |
| FR | 2606752 | A1 * | 5/1988 |
| GB | 2307634 | A * | 6/1997 |
| WO | WO 00/04787 A 1 | | 2/2000 |

OTHER PUBLICATIONS

Trade Brochure entitled "Smart Party Trading Headquarters" published by Apio Inc.
Trade Brochure entitled "All Occasion Party Trays" published by Apio Inc.
"Albertson's Caramel Apple Tray", p. 32A.
"Albertson's Fresh Food Tray", p. 34.
"Albertson's Fresh Melon Tray", p. 35.
Albertson's Fresh Vegetable Tray, p. 37.
Food Technology, Sep. 1988, 70-77, "Modified Atmosphere Packaging of Fresh Produce" by Zagory and Kader.
DuPont Awards, 1989, "Freshold Packaging Systems".
Prepared Foods article, Jun. 1996, "Outsourcing Pre-Cut Veggies Avoids Preparation Costs".

* cited by examiner

PARTY TRAY

CROSS-REFERENCE TO RELATED APPLICATION

This application is related to my copending commonly assigned application for a design patent entitled Party Tray Cover, which is being filed on the same day as this application. The disclosure of that application is incorporated herein by reference.

BACKGROUND OF THE INVENTION

This invention relates to party trays.

The term "party tray" is used herein to denote a tray of assorted foodstuffs to be served at a party. Especially when one or more of the foodstuffs is a respiring foodstuff, for example fresh fruits or vegetables, it is desirable that the party tray should provide a sealed package for the foodstuffs. This makes it possible to use the known technique of modified atmosphere packaging (MAP), and/or to control the initial atmosphere within the party tray, in order to help the foodstuffs to remain in good condition for a longer time, thereby increasing the shelf life of the party tray.

Known sealed party trays are usually prepared in quantity in manufacturing facilities, using carefully selected foodstuffs and under carefully controlled conditions. As displayed for sale, such trays comprise a container body containing separate compartments for different foodstuffs; foodstuffs within the compartments; a transparent polymeric sheet which is sealed over the container body, thus providing a sealed package for foodstuffs; and a transparent cover over the sealing sheet. The size of party trays is such that the sealing sheet is not robust enough to withstand routine handling of the tray unless it is protected by a cover. The container body and the cover are formed by molding polymeric materials, the container body being formed with cavity walls which define the separate compartments. The container body is often black or another solid color to provide a contrasting background for the foodstuffs, but can also be clear.

When the foodstuffs in the known party tray are to be consumed, the cover and the sealing sheet are removed, and the foodstuffs are served, using the container body as the serving tray.

When a party tray is displayed for sale in a supermarket or other store, it is desirable that shoppers should be able to view the contents of the tray clearly, and should have the impression that the tray has been recently prepared at the store level. A disadvantage of the known sealed party trays is that shoppers must view the contents of the tray through the cover and the sealing sheet. This detracts from the appearance of the foodstuffs, and may also indicate to shoppers that the tray has not been prepared at the store level. Another disadvantage is that the cavity walls of the container body are at least 0.375 in. (9 mm) wide. This further detracts from the appearance of the foodstuffs, and also reduces the amount of the foodstuffs that can be placed in a given total volume.

SUMMARY OF THE INVENTION

I have realized, in accordance with the present invention, that improved results can be obtained by loading the foodstuffs into a transparent container body; securing a sealing sheet to the container body to provide a sealed package containing the foodstuffs; placing a support tray over the sealing sheet; and then turning the assembly of the support tray and the sealed package upside-down. In this specification, the term "in the loading orientation" means that the container body is oriented so that any foodstuffs in it rest on the base of the container body; and the term "in the display orientation" means that the container body is oriented so that the base of the container body in the loading orientation provides the top surface of the sealed package. Thus, if a container body, after having been loaded with foodstuffs and sealed with a sealing sheet, is in the display orientation, the foodstuffs rest on the sealing sheet (which is in turn supported by the support tray), and the foodstuffs are viewed by shoppers through the single thickness of the transparent container body. As a result, the foodstuffs are readily visible, and it is not apparent that the party tray was prepared in a manufacturing facility.

When the contents of the novel party tray are to be served, the sealed container body is returned to the loading orientation; the support tray is removed; the sealing sheet is removed; the support tray (or a platter provided by the consumer) is placed over the open container body; the support tray (or provided platter) and container are returned to the display orientation; and finally the container body is removed, so that the foodstuffs can be served from the support tray (or provided platter).

I have also realized, in accordance with the present invention, that by using partitions which are prepared separately from the container body, and are then located within the container body, the partitions can provide a smaller proportion of the visual appearance and physical contents of the party tray. In preferred embodiments, the partitions are located within the container body by location members formed in the base and/or wall of the container body.

This invention includes novel methods for preparing and/or serving party trays, novel container bodies (and other components) for party trays, novel kits of parts for use in the assembly of party trays, and novel party trays, which make use of, or which can be used to implement, the present invention as summarized above. The invention includes, but is not limited to, the specific aspects of the invention which are set out in the Detailed Description of the Invention below.

BRIEF DESCRIPTION OF THE DRAWINGS

The invention is illustrated in the accompanying drawings in which.

Figure 1:
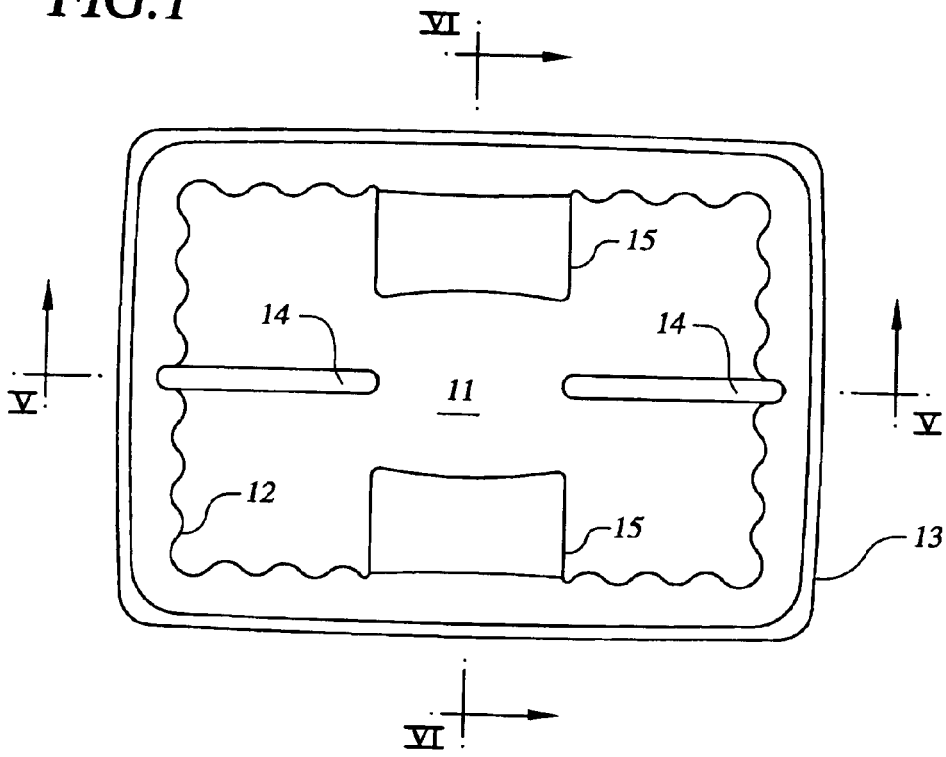
FIGS. 1,2,3 and 4 are top, bottom, front and side views, respectively, of a container body for a party tray according to the invention, the container body being in the display orientation.
Figure 2:
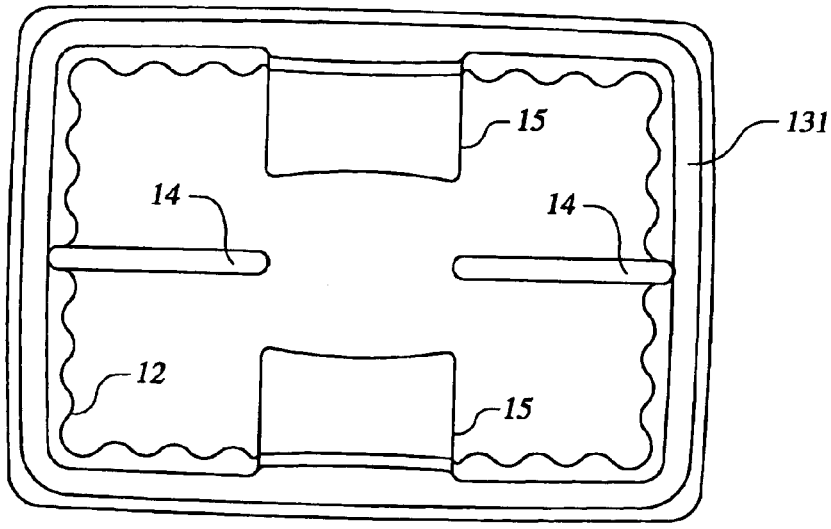
Figure 3:
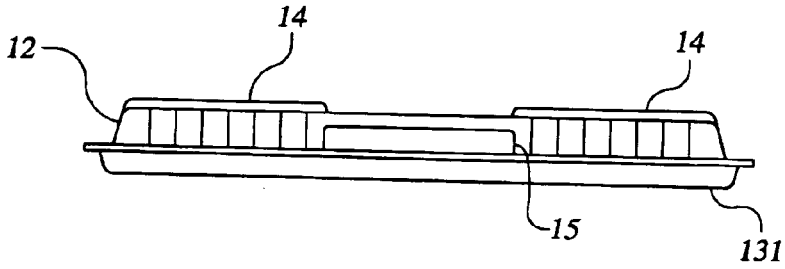
Figure 4:
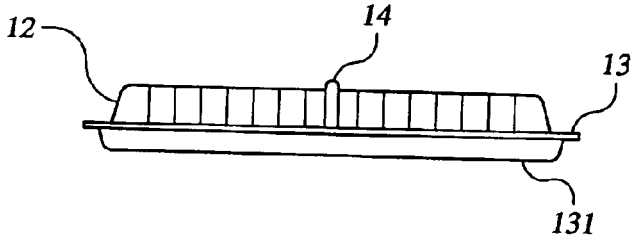
Figure 5:
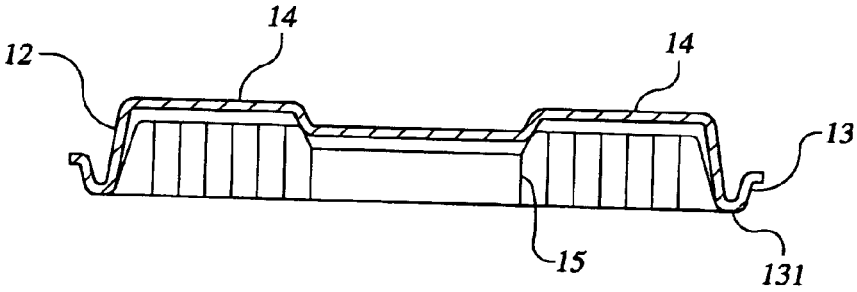
FIGS. 5 and 6 are cross-sections on lines V—V and VI—VI of FIG. 1.
Figure 6:
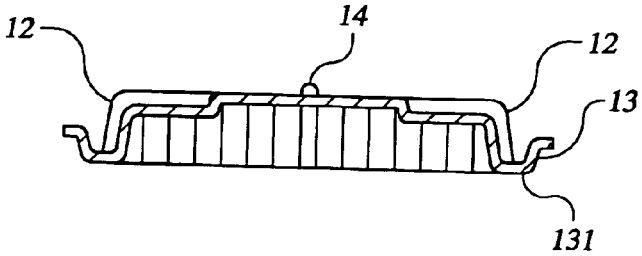

In the drawings, the thicknesses of the components are exaggerated in the interests of clarity. Also the container bodies are shown as having a uniform thickness; in fact, since the container bodies are made by thermoforming polymeric sheets of uniform thickness, their thickness varies, depending upon the amount that the sheet has been deformed, as is well known to those skilled in the art.

DETAILED DESCRIPTION OF THE INVENTION

In the Summary of the Invention above and in the Detailed Description of the Invention, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps etc. are optionally present. For example, an article "comprising" (or "which comprises") components A, B and C can consist of (i.e. contain only) components A, B and C, or can contain not only components A, B and C but also one or more other components. Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility. The term "at least" followed by a number is used herein to denote the start of a range beginning with that number (which may be a range having an upper limit or no upper limit, depending on the variable being defined). For example "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)–(a second number)", this means a range whose lower limit is the first number and whose upper limit is the second number. For example, 25–100 mm means a range whose lower limit is 25 mm, and whose upper limit is 100 mm.

In a second aspect, this invention provides a container body for a party tray, the container body being composed of a transparent polymeric material and comprising 1) a base,
2) a continuous wall which extends away from the base and is contiguous with the base, and
3) a continuous rim which is contiguous with the wall and which comprises a continuous flat surface to which a sheet of polymeric material can be sealed to create a sealed package whose outer surface is defined by the container body and the sheet of polymeric material, at least one of the base and the wall including location members for locating partitions which create compartments within the container body.

In a third aspect, this invention provides a kit of parts which comprises at least one container body as defined in the second aspect of the invention, and at least two partitions, the partitions being locatable by the location members so that they create compartments within the container body. The kit of parts preferably contains at least ten container bodies and at least 20 partitions, and may contain many more.

In a fourth aspect, this invention provides a party tray which comprises

A) a container body which is composed of a transparent polymeric material and which comprises
   1) a base,
   2) a continuous wall which extends away from the base and is contiguous with the base,
   3) a continuous rim which is contiguous with the wall, and
   4) partitions which create compartments within the container body and which are removably located within the container body;
B) foodstuffs in the compartments; and
C) a sealing sheet of polymeric material which is sealed to the rim, thus creating a sealed package which contains the foodstuffs and whose outer surface is defined by the container body and the sealing sheet.

In a fifth aspect, this invention provides a method of serving a party tray which comprises A) placing a party tray as defined in the fourth aspect of the invention in the loading orientation;
B) after step A, removing the sealing sheet;
C) after step B, placing a serving dish over the container body;
D) after step C, turning the assembly prepared in step C upside-down so that the foodstuffs are supported on the serving dish; and
E) after step D, removing the container body so that the foodstuffs are ready to be served.

The sealed packages referred to in describing the invention preferably include an atmosphere control member. The term "atmosphere control member" is used herein to denote any member which modifies the rates at which oxygen and carbon dioxide pass into and out of the sealed package. Atmosphere control members are well-known and are described for example In U.S. Pat. No. 6,376,032 and WO 00/0477, the entire disclosures of which are incorporated herein by reference for all purposes. An atmosphere control member can for example be placed over a window in the container body and/or over a window in the sealing sheet.

The container body is generally prepared by molding, preferably thermoforming, a suitable polymeric material, for example, polyethylene, so that the base, wall and rim are parts of a unitary body. However, the invention includes the possibility that the container body is prepared in some other way, for example by securing together two or more separate components. The container body can be of any convenient shape, for example generally rectangular (including square) with rounded corners, or round. The depth of the container body can be for example 1–4 in. (25–100 mm), e.g. 1.25–2.5 in. (30–65 mm). The circumference of the container body can be for example 30–100 in. (760–2,500 mm), e.g. 40–70 in. (1000–1800 mm). The rim of the container body, to which the sealing sheet is sealed, preferably has a width of at least 0.125 in. (3 mm), e.g. 0.15–0.4 in. (4–10 mm). The thickness of the container body is for example 0.02–0.08 in. (0.5–2 mm), and correspondingly less in areas that have been stretched by thermoforming. The container body is preferably shaped so that a plurality of the bodies can be nested together with little or no space between them.

The methods of the invention are useful with container bodies in which the partitions are cavity walls which are formed at the same time as the base, wall and rim. Preferably, however, the partitions are prepared separately and then located within the container body. This makes it possible for the partitions to have little or no visual impact when the party tray is in the display orientation. Preferably the partitions are composed of transparent polymeric material, e.g. polyethylene or polypropylene, and have a thickness less than 0.125 in. (3 mm), particularly less than 0.04 in. (1 mm), for example 0.02–0.08 in. (0.5–1 mm). Some or all of the partitions may be corrugated for additional strength, and/or include protrusions or channels and/or be shaped (e.g. have slots therein) so that one or more partitions can be maintained in desired locations relative to each other and/or to the base or wall of the container body. Preferably, the partitions can be disassembled from each other; however, the invention includes the possibility that the partitions are secured together so that they cannot be disassembled. Preferably, the partitions can be removed from the container body; however, the invention includes the possibility that they are secured to the container body so that they cannot be removed. The partitions, when installed in the container body, can for example be substantially straight, or comprise two or more straight portions at right angles to each other, or comprise two or more straight portions with a curved portion (e.g. a quarter circle) between them. In one embodiment, two T-shaped partitions are used, each T-shaped partitions being composed of two L-shaped partitions secured to each other along the leg of the T. In another embodiment, two partitions are parallel to each other and one or more partitions are right angles thereto, and some or all of the partitions are slotted so that the partitions fit together in a desired configuration. Preferably the partitions, before being assembled and located in the container body, have a shape (e.g. are substantially flat) such that a plurality of partitions can be nested together with little or no space between them. Some of the partitions can be provided by one or more components which serve an additional purpose. For example, a carton of dressing (e.g. a vegetable dip) can be placed in the center of the container body so that the walls of the carton help to define the compartments into which the foodstuffs are placed. In another embodiment, some or all of the partitions are the part of a unitary body, for example a single molded polymeric article, or a number of molded articles secured to each other so that they cannot be disassembled. The compartments formed by the partitions need not be completely separate from each other, provided that the partitions maintain the desired separation of the foodstuffs.

The partitions can be secured to the base and/or wall of the container body so that they cannot be removed without destroying the container body. Preferably, however, the partitions are removably located in the container body. For this purpose, preferably the base or the wall, or both the base and the wall, include location members for removably locating partitions which have been prepared separately from the rest of the container body. The location members are preferably formed in the container body as it is molded; alternatively, they can be secured to the container body after it has been molded. A wide variety of location members can be employed, and can result in a corresponding variety of design characteristics on the exposed surface of the party tray in the display orientation. For example, the location members can comprise one or more channels which extend away from the interior of the container body. Such a channel can be continuous over the length of the partition, in which case the edge of the partition which fits into the channel can be straight. Alternatively or additionally, part or all of the channel can be discontinuous (e.g. comprise two or more separate short sections), in which case the edge of the partition will include protrusions which fit into the discontinuities. Alternatively or additionally, the location members can comprise one or more ribs which extend into the interior of the container body, in which case the edge of the partition will include one or more conformations, e.g. sockets and/or clips, which interact with the ribs to locate the partition.

The support tray is constructed so that a user can pick up the support tray with the sealed party tray package on it, and so that it protects the sealing sheet during handling of the party tray. Preferably, the support tray is made by thermoforming or otherwise molding a suitable polymeric material, e.g. polyethylene. The thickness of the support tray is for example 0.02–0.08 inch (0.5–2 mm). The support tray can be formed with corrugations, ribs or other conformations which increase its yes meter structural strength. When the sealing sheet includes an atmosphere control member, the support tray preferably comprises ribs such that air can circulate between the support tray and at least the portion of the sealing sheet including the atmosphere control member. The support tray is preferably black or another solid color to provide a contrasting background for viewing the foodstuffs.

Those skilled in the art will have no difficulty, having regard to their own knowledge and the disclosure of this specification, in manufacturing suitable container bodies, partitions and support trays.

The sealing sheet is preferably heat-sealed to rim of the container body. Suitable sealing sheets, and methods for sealing them to the container bodies, are well known, and those skilled in the art will have no difficulty, having regard to their own knowledge and the disclosure of this specification, in identifying suitable sealing sheets and using them to produce sealed packages in accordance with the invention.

The foodstuffs used in the present invention can be of any kind, but the invention is particularly useful when at least one of the foodstuffs is a respiring material, for example a fresh vegetable or fresh fruit. For example, each compartment can contain multiple pieces of a single type of fresh vegetable.

Referring now to the drawings, FIGS. 1–6 show a generally rectangular container body of the invention which is in the display orientation. It comprises a base 11, a wall 12, and a rim 13. The wall is corrugated for added strength. The rim 13 includes a continuous flat surface 131. Two outwardly extending channels 14 and two inwardly extending rectangular depressions 15 are formed in the base and wall. The channels 14 and depressions 15 are location members for partitions to be inserted later, as described below.

Figure 7:
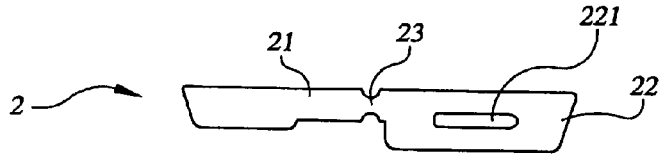
FIGS. 7 and 8 are side and top views respectively of partitions for use in conjunction with the container body illustrated in FIGS. 1–6.
Figure 8:
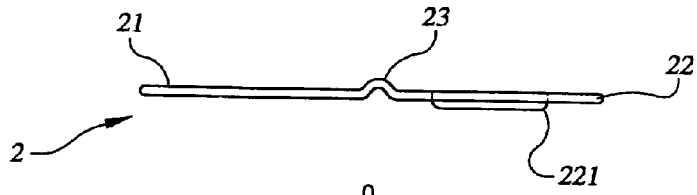
Figure 9:
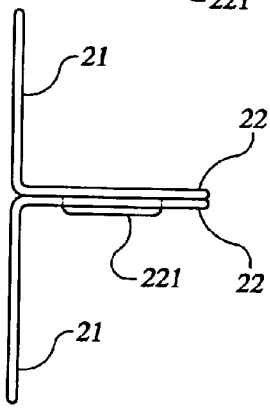
FIG. 9 is a top view of two partitions as shown in FIGS. 7 and 8 joined together to form a single partition.

FIGS. 7 and 8 are side and plan views of a partition 2 comprising wings 21 and 22 with a hinge portion 23 between them. Rib 221 is formed in wing 22. FIG. 9 shows two partitions as shown in FIGS. 7 and 8, with the wings 22 joined together by the ribs 221, and the wings 21 bent at right angles to the wings 22.

Figure 10:
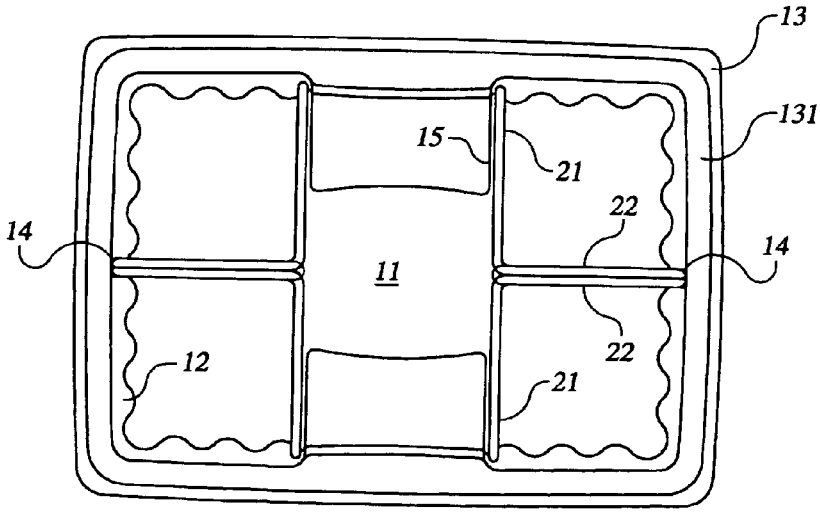
FIG. 10 is a top view of a container body as shown in FIGS. 1–6 into which have been fitted two pairs of partitions as shown in FIGS. 7–8, joined together as shown in FIG. 9, the container body being shown in the loading orientation.

FIG. 10 shows two partitions as shown in FIG. 9 inserted into a container body as shown in FIGS. 1–6, the container body being in the loading orientation, thus creating compartments within the container body.

Figure 11:
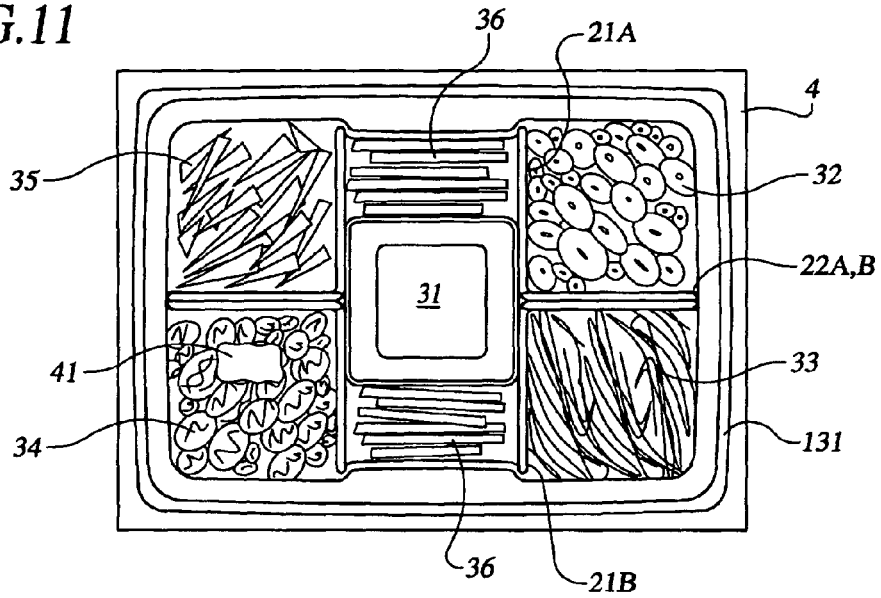
FIG. 11 is a top view of a container body which has been fitted with partitions, as shown in FIG. 10, loaded with vegetables and with a carton of vegetable dip, and then sealed with a polymeric sheet.

FIG. 11 shows the container body of FIG. 10, again in the loading orientation, which has been loaded with a sealed carton 31 of vegetable dip and with a variety of fresh vegetables 32, 33, 34, 35 and 36, and then sealed with a sealing sheet 4. The sealed carton 31 is first placed, upside-down, in the center of the container body, between the rectangular location members 15, thus creating six compartments into which the fresh vegetables are placed. Thereafter, the polymeric sheet 4 is secured to the flat surface 131 of the rim 13. The polymeric sheet 4 includes an atmosphere control member 41.

Figure 12:
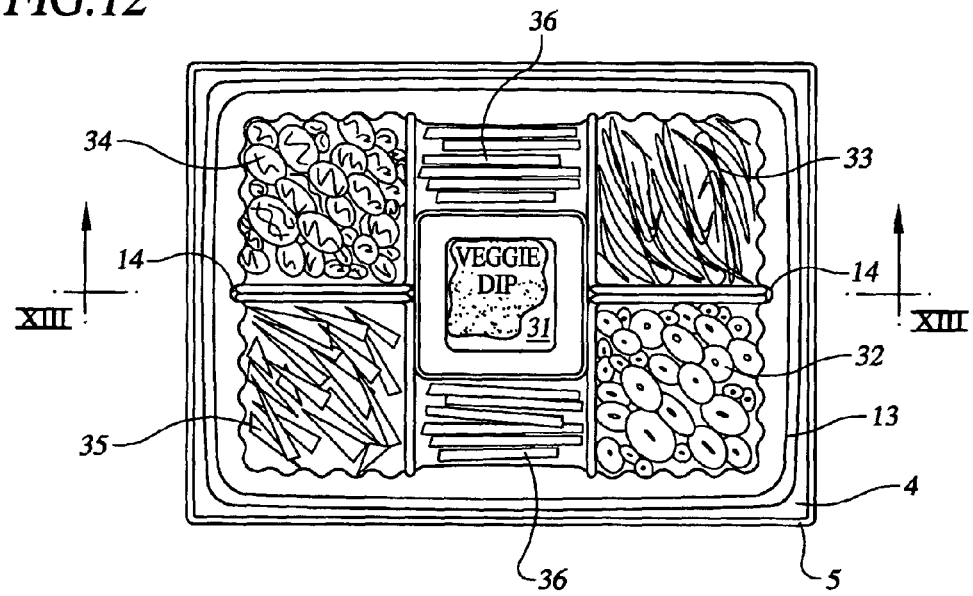
FIG. 12 is a top view of a loaded and sealed container body as shown in FIG. 11, after a support tray has been placed over the sealing sheet, and the assembly then turned over into the display orientation.
Figure 13:
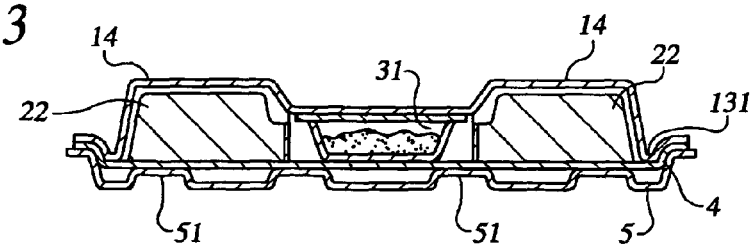
FIG. 13 is a cross-sectional view on line XIII—XIII of FIG. 12.

FIG. 12 shows the loaded and sealed container body of FIG. 11, after a support tray 5 has been placed over it, and the assembly then turned over so that the container body is the display orientation. FIG. 13 is a cross-section on line XIII—XIII of FIG. 12. Support tray 5 has discontinuous upstanding ribs 51 so that air can circulate between the support tray and the sealing sheet 4 and the atmosphere control member 41 can regulate the atmosphere around the fresh vegetables in the party tray.

Figure 14:
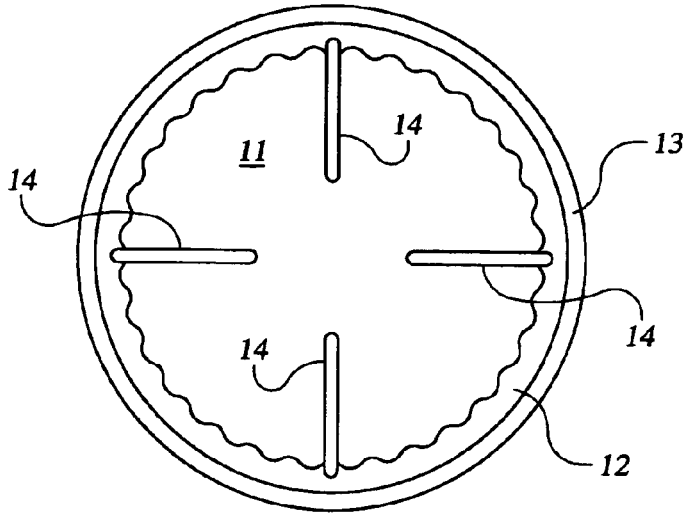
FIGS. 14–16 are top, bottom and side views of another container body for a party tray according to the invention, the container body being in the display orientation.
Figure 15:
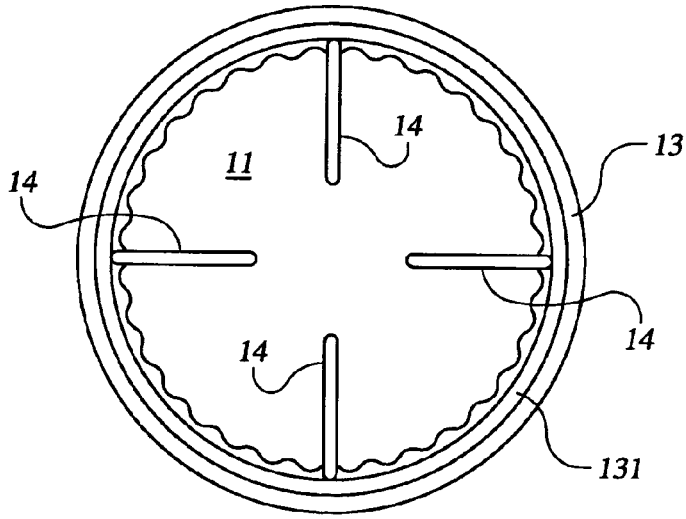
Figure 16:
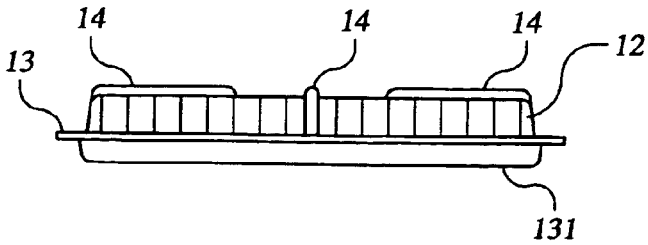

FIGS. 14–16 show a round container body of the invention in the display orientation. It comprises a base 11, a wall 12, and a rim 13. The wall is corrugated for added strength. The rim 13 includes a continuous flat surface 131. Four outwardly extending channels 14 are formed in the base and the wall, and are location members for partitions to be inserted later.

What is claimed is:

1. A method of preparing a party tray which comprises the steps of

A) providing a container body which
- (i) is composed of a transparent polymeric material,
- (ii) has a depth of 1 to 4 in.,
- (iii) has a circumference of 30 to 100 in.; and
- (iv) comprises
  - 1) a base,
  - 2) a continuous wall which extends away from the base and is contiguous with the base,
  - 3) a continuous rim which is contiguous with the wall, and
  - 4) partitions which extend away from the base in the same direction as the wall; and
- (v) has a loading orientation in which the wall extends upwards from the base, and the partitions extend upwards from the base and create fillable compartments within the container body;

the partitions being cavity walls, and the container body having been prepared by molding a polymeric material, thus forming the base, wall, rim and partitions at the same time;

B) while the container body is in the loading orientation, placing foodstuffs in the compartments so that the foodstuffs rest on the base, at least some of the foodstuffs being fresh vegetables and the foodstuffs placed in at least one of the compartments being multiple pieces of a fresh vegetable;

C) after step B, and without any intermediate step between step B and step C, sealing a sealing sheet of polymeric material to the rim of the container body so that the sealing sheet extends over the compartments and creates a sealed package (i) which contains the foodstuffs and a packaging atmosphere around the foodstuffs, (ii) whose outer surface is defined by the container body end the sealing sheet, and (iii) which includes an atmosphere control member included in the sealing sheet;

D) after step C, placing a support tray over the sealing sheet; and

E) after step D, turning the sealed package and the support tray placed thereon upside-down, so that the foodstuffs rest on the sealing sheet, and the sealing sheet is supported by the support tray, the support tray comprising ribs such that, after step (E) air can circulate between the support tray and the atmosphere control member;

whereby the party tray can be displayed for sale in a display orientation in which the foodstuffs are viewed by a shopper through the container body.

2. A method according to claim 1 wherein the support tray has a solid color.

3. A method according to claim 1 wherein the atmosphere control member covers a window in the sealing sheet.

4. A method according to claim 1 wherein the ribs on the support tray are discontinuous, upstanding ribs.

5. A method according to claim 1 wherein, before step B, a carton of vegetable dip is placed in the center of the container body, and the carton has walls which help to define the compartments.

6. A method according to claim 1 wherein the atmosphere control member provides substantially the only pathways for oxygen and carbon dioxide to enter or leave the packaging atmosphere.

7. A method according to claim 1 which includes, after step E, the step of displaying the party tray for sale in a display orientation in which the foodstuffs are viewed by a shopper through the container body.

8. A method of preparing a party tray which comprises the steps of

A) providing a container body which
- (i) is composed of a transparent polymeric material,
- (ii) has a depth of 1 to 4 in.,
- (iii) has a circumference of 30 to 100 in.; and
- (iv) comprises
  - 1) a base,
  - 2) a continuous wall which extends away from the base and is contiguous with the base,
  - 3) a continuous rim which is contiguous with the wall, and
  - 4) partitions which extend away from the base in the same direction as the wall; and
- (v) has a loading orientation in which the wall extends upwards from the base, and the partitions extend upwards from the base and create fillable compartments within the container body;

the partitions being cavity walls, and the container body having been prepared by molding a polymeric material, thus forming the base, wall, rim and partitions at the same time;

B) while the container body is in the loading orientation, placing foodstuffs in the compartments so that the foodstuffs rest on the base, at least some of the foodstuffs being fresh vegetables and the foodstuffs placed in at least one of the compartments being multiple pieces of a fresh vegetable;

C) after step B, sealing a sealing sheet of polymeric material to the rim of the container body so that the sealing sheet extends over the compartments and creates a sealed package (i) which contains the foodstuffs and a packaging atmosphere around the foodstuffs, (ii) whose outer surface is defined by the container body and the sealing sheet, and (iii) which includes an atmosphere control member included in the sealing sheet;

D) after step C, placing a support tray over the sealing sheet; and

E) after step D, turning the sealed package and the support tray placed thereon upside-down, so that the foodstuffs rest on the sealing sheet, and the sealing sheet is supported by the support tray, the support tray comprising ribs such that, after step (E), air can circulate between the support tray and the atmosphere control member;

whereby the party tray can be displayed for sale in a display orientation in which the foodstuffs are viewed by a shopper through the container body.

9. A method according to claim 8 wherein the atmosphere control member covers a window in the sealing sheet.

10. A method according to claim 8 wherein the support tray has a solid color.

11. A method according to claim 8 wherein the ribs on the support tray are discontinuous, upstanding ribs.

12. A method according to claim 8 wherein, before step B, a carton of vegetable dip is placed in the center of the container body, and the carton has walls which help to define the compartments.

13. A method according to claim 8 which includes, after step E, the step of displaying the party tray for sale in a display orientation in which the foodstuffs are viewed by a shopper through the container body.

14. A method of preparing a party tray which comprises the steps of

A) providing a container body which (i) is composed of a transparent polymeric material, (ii) has a depth of 1 to 4 in., (iii) has a circumference of 30 to 100 in.;

(iv) comprises 1) a base, 2) a single continuous wall which extends away from the base and is contiguous with the base, 3) a continuous rim which is contiguous with the wall, and 4) partitions which extend away from the base in the same direction as the wall, and are removably located in the container body; and (v) has a loading orientation In which the wall extends upwards from the base, and the partitions extend upwards from the base and create fillable compartments within the container body; and B) while the container body is in the loading orientation, placing foodstuffs in the compartments so that the foodstuffs rest on the base, at least some of the foodstuffs being fresh vegetables and the foodstuffs placed in at least one of the compartments being multiple pieces of a fresh vegetable;

C) after step B, sealing a sealing sheet of polymeric material to the rim of the container body so that the sealing sheet extends over the compartments and creates a sealed package (i) which contains the foodstuffs and a packaging atmosphere around the foodstuffs, (ii) whose outer surface is defined by the container body and the sealing sheet, and (iii) which includes an atmosphere control member included in the sealing sheet;

D) after step C, placing a support tray over the sealing sheet; and

E) after step D, turning the sealed package and the support tray placed thereon upside-down, so that the foodstuffs rest on the sealing sheet, and the sealing sheet is supported by the support tray the support tray comprising ribs such that, after step (E), air can circulate between the support tray and the atmosphere control member;

whereby the party tray can be displayed for sale in a display orientation in which the foodstuffs are viewed by a shopper through the container body.

15. A method according to claim 14 wherein the partitions are composed of a polymeric material having a thickness less than 0.125 inch.

16. A method according to claim 14 wherein, before step B, a carton of vegetable dip is placed in the center of the container body, and the carton has walls which help to define the compartments.

17. A method according to claim 14 wherein the atmosphere control member provides substantially the only pathways for oxygen and carbon dioxide to enter or leave the packaging atmosphere.

18. A method according to claim 14 which includes, after step E, the step of displaying the party tray for sate in a display orientation in which the foodstuffs are viewed by a shopper through the container body.

19. A method according to claim 14 wherein the container body includes location members formed in the container body as the container body was molded, the location members being in the base of the container body or in the wall of the container body, or in both the base and the wall of the container body, whereby, when all the partitions are located within the container body by the location members, each of the compartments has a fixed size.

20. A method according to claim 14 where the partitions have one or more of the following characteristics (a) at least one of the partitions comprises two or more straight portions at right angles to each other and to the base, (b) at least one of the partitions comprises two or more straight portions at right angles to the base and with a curved portion between them, and (c) two or more first partitions which are parallel to each other and at right angles to the base, and one or more second partitions which are at right angles to the first partitions and to the base, some or all of the first and second partitions are slotted so that they fit together.

21. A method according to claim 14 wherein the support tray has a solid color.

22. A method according to claim 14 wherein the ribs on the support tray are discontinuous, upstanding ribs.

23. A method according to claim 14 wherein the atmosphere control member covers a window in the sealing sheet.

* * * * *

UNITED STATES PATENT AND TRADEMARK OFFICE

CERTIFICATE OF CORRECTION

PATENT NO. : 7,083,818 B2
APPLICATION NO. : 10/222435
DATED : August 1, 2006
INVENTOR(S) : Wesley Paul Pratte It is certified that error appears in the above-identified patent and that said Letters Patent is hereby corrected as shown below:

Column 3, before line 62 insert the following paragraphs:

-- In a first aspect, this invention provides a method of preparing a party tray which comprises the steps of A) providing a container body which is composed of a transparent polymeric material and which comprises
   1) a base,
   2) a continuous wall which extends away from the base and is contiguous with the base,
   3) a continuous rim which is contiguous with the wall, and
   4) partitions which create compartments within the container body;
B) placing foodstuffs in the compartments;
C) after step B, sealing a sealing sheet of polymeric material to the rim of the container body, thus creating a sealed package which contains the foodstuffs and whose outer surface is defined by the container body and the sealing sheet;
D) after step C, placing a support tray over the sealing sheet; and
E) after step D, turning the assembly produced in step D upside-down. --;

Column 8, line 1 replace “end” with -- and --;

Column 9, line 45 replace “In” with -- in --; and

Column 10, line 9 replace “tray” with -- tray, --.

Signed and Sealed this

Second Day of September, 2008

JON W. DUDAS
*Director of the United States Patent and Trademark Office*